US005289663A

United States Patent [19]

Schlüter

[11] Patent Number: 5,289,663

[45] Date of Patent: Mar. 1, 1994

[54] FLOOR MOLDING

[75] Inventor: Werner Schlüter, Iserlohn, Fed. Rep. of Germany

[73] Assignee: Schluter Systems GmbH, Iserlohn, Fed. Rep. of Germany

[21] Appl. No.: 985,889

[22] Filed: Dec. 4, 1992

[30] Foreign Application Priority Data

Dec. 17, 1991 [DE] Fed. Rep. of Germany ..... 4141600

[51] Int. Cl.[5] ..... E04B 1/00

[52] U.S. Cl. ..... 52/287.1; 52/717.03; 52/717.05

[58] Field of Search ..... 52/396, 403, 272, 273, 52/287, 288, 717.03, 717.05; 403/403, 282, 205, 231

[56] References Cited

U.S. PATENT DOCUMENTS

| | | | |
|---|---|---|---|
| 3,292,330 | 12/1966 | Tennison | 52/396 X |
| 3,616,113 | 10/1971 | Sawyer | 52/273 X |
| 4,014,618 | 3/1977 | Kristiansen | 403/403 X |
| 4,204,376 | 5/1980 | Cavert | 52/288 |
| 4,409,758 | 10/1983 | Dickson et al. | 52/202 X |
| 4,932,171 | 6/1990 | Beattie | 52/273 X |
| 5,058,340 | 10/1991 | Muller | 52/273 X |
| 5,203,640 | 4/1993 | Pourtau et al. | 52/287 X |

FOREIGN PATENT DOCUMENTS

| | | | |
|---|---|---|---|
| 198157 | 1/1986 | European Pat. Off. . | |
| 449733 | 3/1991 | European Pat. Off. . | |
| 3503396 | 8/1986 | Fed. Rep. of Germany . | |
| 2171734 | 5/1986 | United Kingdom | 52/287 R |
| 9015135 | 4/1991 | United Kingdom . | |

*Primary Examiner*—Peter M. Cuomo
*Assistant Examiner*—Jerry Redman
*Attorney, Agent, or Firm*—Collard & Roe

[57] ABSTRACT

A floor molding forming a transition at a corner between a floor and a wall disposed at a right angle to the floor. The floor and wall are both tiled with each tile having a bottom surface, side edges and a top surface. A wall bracket is secured between the wall and the wall tiles, including a leg disposed adjacent to the side edge of the wall tile facing the corner. A floor bracket is secured between the floor and the floor tiles at a distance from the wall bracket forming a gap therebetween. The floor bracket has an L-shaped member including a leg disposed adjacent to the side edge of the floor tile facing the corner. The L-shaped member also includes an arm connected to the leg disposed adjacent to the top surface of the floor tile. An elastic plastic bridge is coupled between the wall bracket leg and the floor bracket L-shaped member across the gap. The elastic plastic bridge permits relative movement between said wall bracket and said floor bracket while maintaining the transition between the wall and the floor.

13 Claims, 2 Drawing Sheets

FLOOR MOLDING

BACKGROUND OF THE INVENTION

1. Field of the Invention

The present invention relates to a floor molding forming a transition bridge at a corner between a floor and a wall. More specifically, the invention relates to a floor molding for use with a tiled floor and a tiled wall.

2. The Prior Art

The German Patent DE-OS 35 03 396 discloses two separate plastic angle sections which form a sliding connection. This sliding connection may compensate for movement between surfaces due to changes in the floor structure and thermal expansion or contraction. These connections are particularly useful if the floor is to be arranged on a heat insulating layer, for example, polystyrene foam sold under the trademark STYROPOR. Heat and sound insulation boards become compressed over time which can lower the height of the floor.

The angle sections are provided with relatively thin fastening legs which contain perforations and are attached to the floor or wall by being placed into the mortar or adhesive layer between the wall or floor and the tile. The angle section connected to the wall is provided with an elastically-linked connecting leg which slidingly engages a pocket formed on the floor mounted angle section. As the floor and its angle section sink, the connecting leg is exposed as it slides out of the pocket.

With the known device, it is difficult to form the joint between the floor tiles and the angle section which is secured to the floor. Due to the irregular angles formed between the floor and wall surfaces, the edges of the perimeter tiles have to be cut. The irregularities of the joint, as a rule, are filled with joint mortar. The transition zone between the angle section secured on the wall and the angle section secured on the floor remains visible with the prior art device, as does the top side of the angle section secured on the floor. Therefore, the angle sections cannot be made from recycled material which tends to show variations in color.

With adjacent tiled surfaces where only minor movement or settling is expected, the use of a device having two assembled sections is relatively costly. Another drawback exists in the fact that when the sections are slid together, an open joint remains between the pocket and the inserted leg. This joint cannot be sealed because of the required relative movement between the two sections. There is a risk that bacteria or other contaminants may enter the joint which poses a particular problem in large institutional kitchens.

SUMMARY OF THE INVENTION

It is therefore an object of the present invention to provide a floor molding which overcomes the drawbacks of the prior art and provides a tight seal between the wall and the floor.

It is also an object of the present invention to provide a floor molding which can be made from recycled plastic or metal.

It is yet a further object of the present invention to provide a floor molding which is aesthetically pleasing.

These and other related objects are achieved according to the invention by a floor molding for forming a transition at a corner between a floor and a wall disposed at a right angle to the floor. The floor and the wall are both tiled with each tile having a bottom surface, side edges, and a top surface. A wall bracket is secured between the wall and the wall tiles, including a leg disposed adjacent to the side edge of the wall tile facing the corner. A floor bracket is secured between the floor and the floor tiles at a distance from the wall bracket forming a gap therebetween. The floor bracket has an L-shaped member including a leg disposed adjacent to the side edge of the floor tile facing the corner and an arm connected to the leg disposed adjacent to the top surface of the floor tile. An elastic plastic bridge is coupled between the wall bracket leg and the floor bracket L-shaped member across the gap. The elastic plastic bridge permits relative movement between the wall bracket and the floor bracket while maintaining the transition between the wall and the floor.

In a preferred embodiment of the invention, two elastic plastic bridges are connected between the wall bracket and the floor bracket. The hollow space formed between the two plastic bridges permit movement of the brackets in the horizontal or vertical direction with respect to each other. The plastic bridge is preferably flexible and molded onto the wall bracket and floor bracket.

The floor molding according to the invention is particularly useful if the expected movement between the wall and the floor is relatively small. Generally, the settling of the floor is minor if, for example, sound insulation or other insulation materials are not used in the construction of the floor. These insulating materials can settle because of their low density.

The tiles along the periphery of the floor are placed into a pocket formed between the floor bracket and the L-shaped member. As a result, the joint between the floor tiles and the floor bracket is not visible. The arm of the floor bracket which is disposed adjacent to the top surface of the floor tile is covered by the elastic plastic bridge which forms an attractive transition from the floor to the wall. Since the brackets are completely covered by the plastic bridge, recycled plastic or metal can be used to make the brackets. In this manner, only the plastic bridge requires a uniformly dyed surface. The plastic bridge can be applied to both brackets by injection molding.

BRIEF DESCRIPTION OF THE DRAWINGS

Other objects and features of the present invention will become apparent from the following detailed description considered in connection with the accompanying drawings, which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 2:
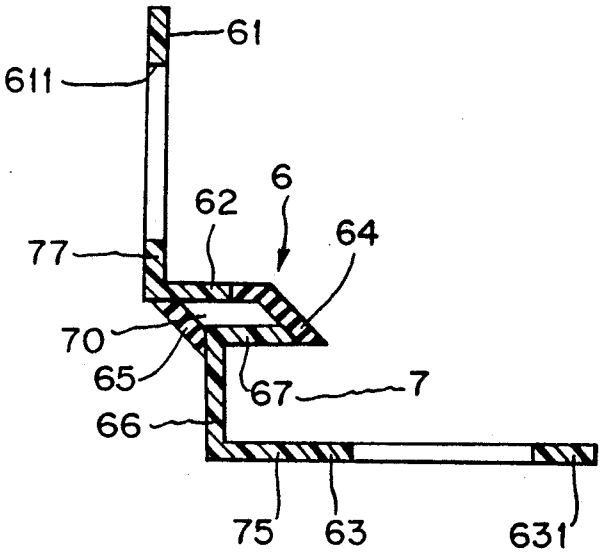
FIG. 2 is a cross-sectional view through the floor molding without the tiles.
Figure 1:
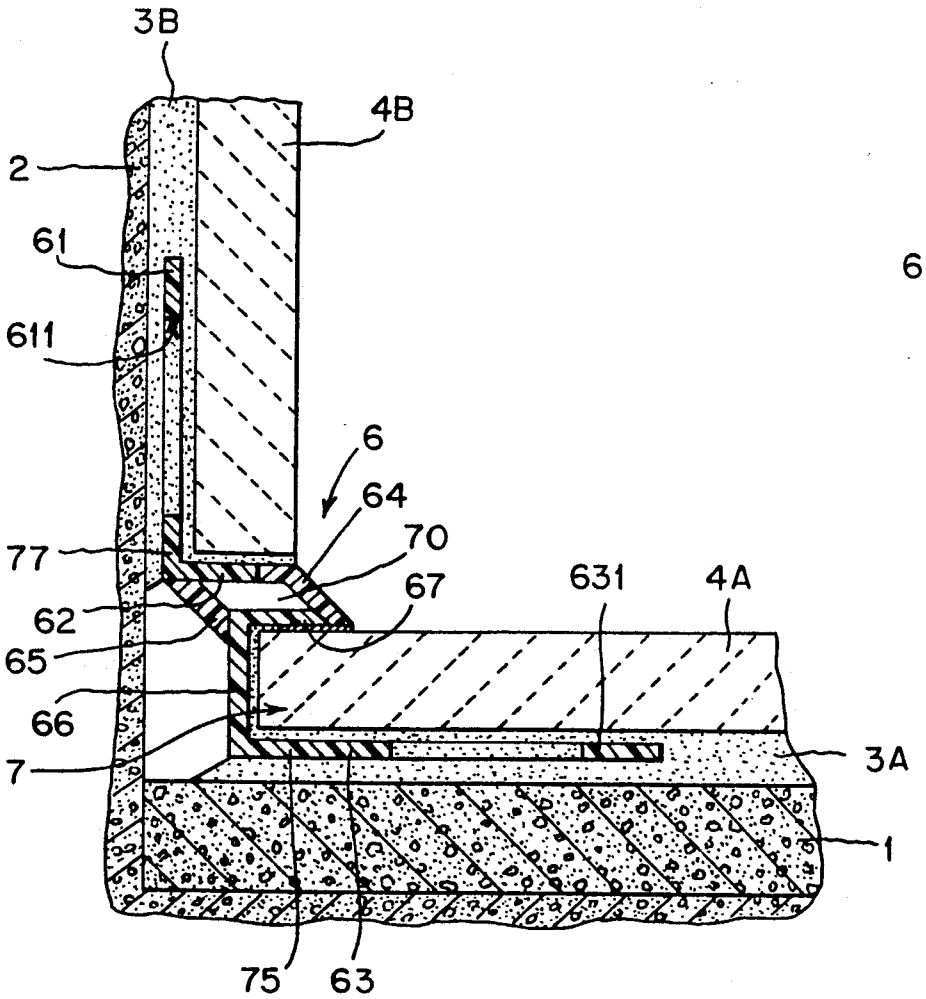
FIG. 1 is a cross-sectional view of the floor molding according to the invention, installed in a corner and showing a floor tile and a wall tile.

Referring now in detail to the drawings and, in particular, FIGS. 1 and 2, there is shown a floor 1 with tiles 4A and a wall 2 with tiles 4B forming a corner. A floor molding 6 is shown having a floor bracket 63 and a wall bracket 61 having perforations 631 and 611, respectively. Wall bracket 61 includes a wall baseplate 77 and a leg 62 and is made of a hard material, such as hard plastic or metal. Wall bracket 61 is secured between wall 2 and wall tile 4B by adhesive or mortar 3B. The adhesive or mortar 3B surrounds wall baseplate 77 and fills in perforation 611 to secure tile 4B directly to wall 2.

Floor bracket 63 includes a floor baseplate 75, a leg 66 and an arm 67 coupled to the end of leg 66. Floor bracket 63 is made of a hard material, such as hard plastic or metal, and is secured between floor 1 and tile 4A with adhesive or mortar 3A. The adhesive or mortar 3A surrounds floor baseplate 75 and fills in perforation 631 to secure tile 4A directly to floor 1. Floor baseplate 75 is disposed parallel to floor 1 and tile 4A and transverse to wall 2, wall baseplate 77 and tile 4B.

Two elastic plastic bridges 64 and 65 are connected between wall bracket 61 and floor bracket 63. The bridges are parallel to each other and are inclined, for example, at a 45° angle between the floor tile 4A and wall tile 4B. Bridges 64 and 65 can be molded onto the brackets as a soft elastic plastic material. Preferably, the brackets can be manufactured from a still or hard recycled material, such as plastic or metal. The bridges 64 and 65 are then injection molded in a subsequent step from a uniformly dyed plastic material. Bridges 64 and 65 and leg 62, leg 66 and arm 67 define a hollow space 70 which permits relative movement between brackets 61 and 63 in a horizontal and vertical plane.

Floor bracket 63 includes a pocket 7 formed between floor baseplate 75, leg 66, and arm 67. Leg 66 and arm 67 form an L-shaped member with leg 66 perpendicular to floor baseplate 75. Arm 67 is perpendicular to leg 66 and parallel to floor baseplate 75. The distance between floor baseplate 75 and arm 67, along leg 66 is configured and dimensioned to accommodate the height of a tile with a bead of adhesive or mortar surrounding the tile to secure it to the baseplate. The edge of floor tile 4A is placed within pocket 7 so that the space between leg 66 and the edge of tile 4A is not visible. Therefore, if tile 4A has to be cut, in order to fit it into the corner, a built in clearance is provided equalling the width of arm 67. As can be appreciated, mortar 3B between tile 4B and leg 62 forms a tight seal between bridge 64 and tile 4B. Similarly, mortar 3A between tile 4A and leg 66 forms a tight seal between bridge 64 and tile 4A. Therefore, a continuous transition or seal is provided between floor tile 4A and wall tile 4B even with relative movement between floor 1 and wall 2.

Figure 3B:
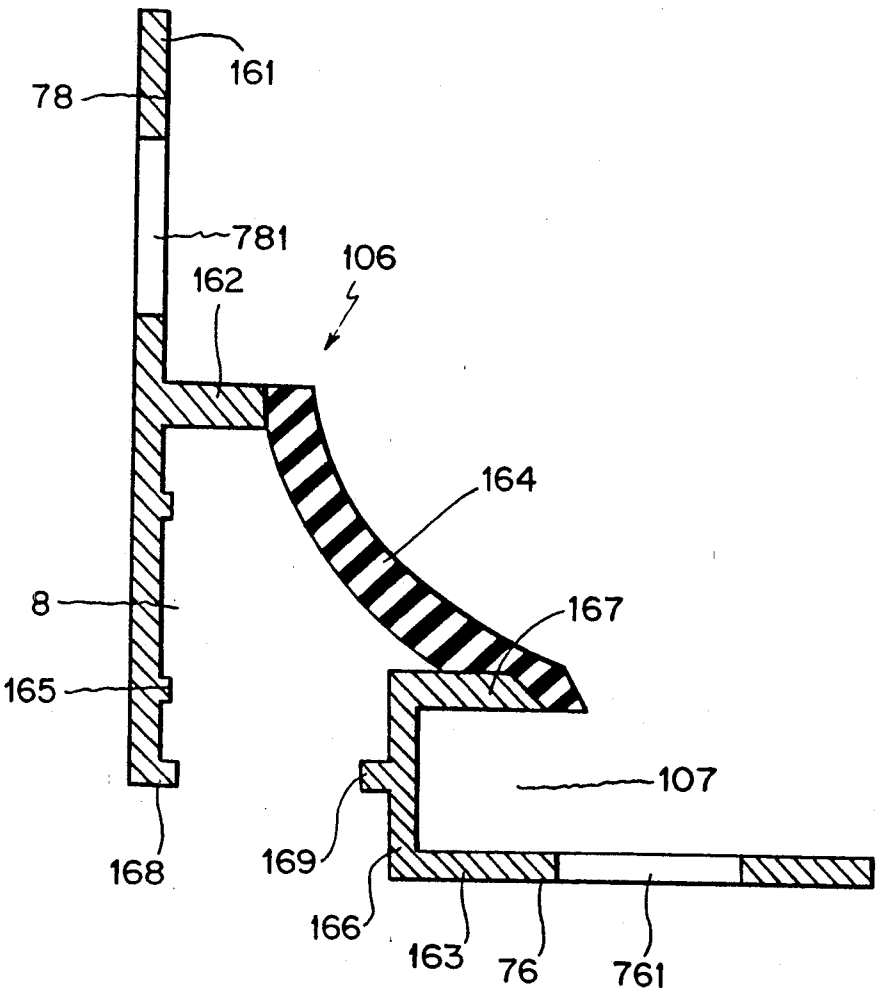
FIGS. 3A and 3B are cross-sectional views through an alternate embodiment of the floor molding.
Figure 3A:
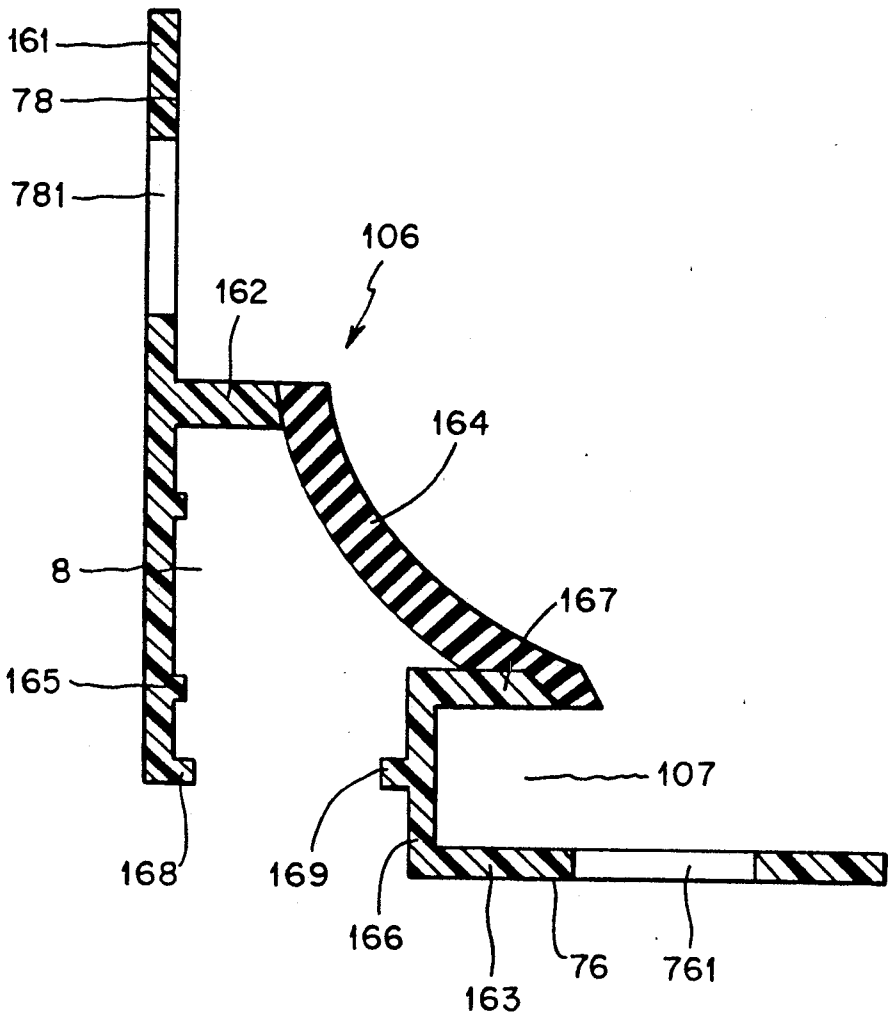

Referring now to FIG. 3, there is shown a one-piece floor molding 106 for forming a transition bridge. Floor molding 106 has a fillet appearance, i.e. a concave strip forming a rounded interior angle. Floor molding 106 includes a wall bracket 161 made of a hard material, such as hard plastic or metal, securable to the wall. Wall bracket 161 includes a wall baseplate 78 which is provided with perforations 781. A floor bracket 163 is made of a hard material, such as hard plastic or metal, and is securable to the floor. Floor bracket 163 includes a floor baseplate 76 which is provided with perforations 761. Floor bracket 163 includes a leg 166 and an arm 167 molded thereon. Floor bracket 163, leg 166 and arm 167 cooperatively form a pocket 107 for receiving the floor tile. Floor bracket 163, leg 166 and arm 167 are molded out of the hard material. Floor bracket 163 and wall bracket 161 are connected by an elastic plastic bridge 164 having a fillet-like appearance. Elastic plastic bridge 164 is coupled between a leg 162 of wall bracket 161 and arm 167 and is preferably formed by molding. Elastic plastic bridge 164 permits relative motion between wall bracket 161 and floor bracket 163 and their respective ceramic tile surfaces.

An extension 165 of wall bracket 161 extends beyond leg 162 toward the corner. The free end of extension 165 includes a molded rib 168 facing leg 166. Leg 166 has a corresponding molded rib 169 which faces extension 165. Ribs 168 and 169 are molded in place. A hollow space 8 is formed between leg 162, extension 165, leg 166, arm 167 and plastic bridge 164. Hollow space 8 opens downwardly toward the corner, a small section of the wall and a larger section of the floor. Connecting and/or sealing components may be accommodated in space 8 for connecting adjacent floor moldings together or for sealing an end strip of floor molding.

The hard plastic material can be made of a thermoplastic, such as polyolefin, such as polyethylene, polyvinyl chloride, or a thermosetting resin, such as a phenol formaldehyde resin. The hard metal can be aluminum, brass, or steel.

While several embodiments of the present invention have been shown and described, it is to be understood that many changes and modifications may be made thereunto without departing from the spirit and scope of the invention as defined in the appended claims.

What is claimed is:

1. A floor molding forming a transition at a corner between a floor and a wall disposed at a right angle to the floor, the floor having floor tiles and the wall having wall tiles, with each tile having a bottom surface, a side edge and a top surface, comprising:

a wall bracket securable between the wall and the wall tiles including a wall bracket leg disposed adjacent to the side edge of the wall tile facing the corner;

a floor bracket securable between the floor and the floor tiles at a distance from said wall bracket and forming a gap therebetween, said floor bracket having an L-shaped member including a floor bracket leg disposed adjacent to the side edge of the floor tile facing the corner and a floor bracket arm, connected to said floor bracket leg, disposed adjacent to the top surface of the floor tile; said floor bracket forming a pocket for receiving the floor tile; and an elastic plastic bridge coupled between said wall bracket leg and said floor bracket arm across the gap, said bridge contacting said floor bracket arm adjacent to the top surface of the floor tile whereby said bridge permits relative movement between said wall bracket and said floor bracket while maintaining the transition between the wall and the floor.

2. A floor molding according to claim 1, wherein said bridge is flexible and is molded onto said wall bracket leg and said floor bracket L-shaped member.

3. A floor molding according to claim 1, wherein said bridge is concavely shaped and is coupled to said floor bracket arm in an overlying relationship thereto.

4. A floor molding forming a transition at a corner between a floor and a wall disposed at a right angle to the floor, the floor having floor tiles and the wall having wall tiles, with each tile having a bottom surface, a side edge and a top surface, comprising:

a wall bracket securable between the wall and the wall tiles including a wall bracket leg disposed adjacent to the side edge of the wall tile facing the corner;

a floor bracket securable between the floor and the floor tiles at a distance from said wall bracket and forming a gap therebetween, said floor bracket having an L-shaped member including a floor bracket leg disposed adjacent to the side edge of the floor tile facing the corner and a floor bracket arm, connected to said floor bracket leg, disposed adjacent to the top surface of the floor tile; and two elastic, flexible plastic bridges, one of said bridges being molded between said wall bracket leg and said floor bracket leg across the gap, the other of said bridges being molded between said wall bracket leg and said floor bracket arm across the gap with a hollow space formed between said two bridges, whereby said bridges permit relative movement between said wall bracket and said floor bracket while maintaining the transition between the wall and the floor.

5. A floor molding according to claim 4, wherein said wall bracket includes a wall baseplate disposed parallel to the bottom surface of the wall tile and the wall, said wall bracket leg is transverse to said wall baseplate.

6. A floor molding according to claim 5, wherein said wall baseplate includes perforations.

7. A floor molding according to claim 6, wherein said floor bracket includes a floor baseplate disposed parallel to the bottom surface of the floor tile and the floor, said floor bracket leg is transverse to said floor baseplate, and said floor bracket arm is transverse to said floor bracket leg and parallel to said floor baseplate.

8. A floor molding according to claim 7, wherein said floor baseplate includes perforations.

9. A floor molding according to claim 8, wherein said floor baseplate, said floor bracket leg and said floor bracket arm cooperatively form a pocket for receiving the side edge of the floor tile.

10. A floor molding forming a transition at a corner between a floor and a wall disposed at a right angle to the floor, the floor having floor tiles and the wall having wall tiles, with each tile having a bottom surface, a side edge and a top surface, comprising:

a wall bracket securable between the wall and the wall tiles including a wall bracket leg disposed adjacent to the side edge of the wall tile facing the corner, said wall bracket including an extension that extends beyond said wall bracket leg toward the corner defining one side of a hollow space;

a floor bracket securable between the floor and the floor tiles at a distance from said wall bracket and forming a gap therebetween, said floor bracket having an L-shaped member including a floor bracket leg disposed adjacent to the side edge to the floor tile facing the corner and a floor bracket arm, connected to said floor bracket leg, disposed adjacent to the top surface of the floor tile; and a concavely shaped elastic, plastic bridge coupled between said wall bracket leg and said floor bracket L-shaped member across the gap, said bridge is coupled to said floor bracket arm in an overlying relationship thereto; said bridge, said wall bracket leg and said floor bracket leg defining other sides of the hollow space, whereby said bridge permits relative movement between said wall bracket and said floor bracket while maintaining the transition between the wall and the floor.

11. A floor molding according to claim 10, wherein said extension and said floor bracket leg each include a molded rib, said ribs face each other across the hollow space.

12. A floor molding according to claim 11, wherein said brackets are plastic.

13. A floor molding according to claim 11, wherein said brackets are metal.

* * * * *